US010460693B2

(12) United States Patent
Chen

(10) Patent No.: US 10,460,693 B2
(45) Date of Patent: Oct. 29, 2019

(54) LIQUID CRYSTAL PANEL AND DISPLAY DRIVING METHOD THEREOF FOR COMPENSATING COLOR CAST TO IMPROVE VIEWING ANGLES

(71) Applicant: Shenzhen China Star Optoelectronics Technology Co., Ltd., Shenzhen, Guangdong (CN)

(72) Inventor: Shuai Chen, Guangdong (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 17 days.

(21) Appl. No.: 15/737,568

(22) PCT Filed: Jul. 18, 2017

(86) PCT No.: PCT/CN2017/093422

§ 371 (c)(1),
(2) Date: Dec. 18, 2017

(87) PCT Pub. No.: WO2018/232808

PCT Pub. Date: Dec. 27, 2018

(65) Prior Publication Data

US 2019/0005912 A1 Jan. 3, 2019

(30) Foreign Application Priority Data

Jun. 23, 2017 (CN) ..... 2017 1 0488672

(51) Int. Cl.
*G09G 3/36* (2006.01)

(52) U.S. Cl.
CPC ..... *G09G 3/3696* (2013.01); *G09G 3/3677* (2013.01); *G09G 3/3688* (2013.01); *G09G 2300/0452* (2013.01); *G09G 2320/0242* (2013.01)

(58) Field of Classification Search
CPC ..... G09G 3/18; G09G 3/3406–3426; G09G 3/36–3696; G09G 5/02; G09G 2300/0439–0895
See application file for complete search history.

(56) References Cited

U.S. PATENT DOCUMENTS

2005/0227396 A1* 10/2005 Chang ..... G09G 3/3648 438/30
2012/0169695 A1* 7/2012 Chang ..... G09G 3/3648 345/211
2013/0201174 A1* 8/2013 Pyun ..... G09G 3/3607 345/213

* cited by examiner

*Primary Examiner* — Sanghyuk Park
(74) *Attorney, Agent, or Firm* — Mintz Levin Cohn Ferris Glovsky and Popeo, P.C.; Kongsik Kim; Jhongwoo Jay Peck

(57) ABSTRACT

The present disclosure provides a liquid crystal panel, which includes N scan lines, M data lines and N×M pixels arranged in array; when the liquid crystal panel is driven to display, n scan lines that are adjacent to each other receive high potential signals simultaneously, and M data lines receive data signals simultaneously in a duration of the high potential signal; and n scan lines receive low potential signals simultaneously in a duration of a first low potential signal, n scan lines receive low potential signals having the lowest voltage simultaneously in a duration of a second low potential signal, and M data lines receive common voltage signals simultaneously in the duration of the first low potential signal and the duration of the second low potential signal; and 2≤n≤N.

12 Claims, 3 Drawing Sheets

LIQUID CRYSTAL PANEL AND DISPLAY DRIVING METHOD THEREOF FOR COMPENSATING COLOR CAST TO IMPROVE VIEWING ANGLES

CROSS-REFERENCES TO RELATED APPLICATIONS

This application is a U.S. national phase application, pursuant to 35 U.S.C. § 371, of PCT/CN2017/093422, filed Jul. 18, 2017, designating the United States, which claims priority to Chinese Application No. 201710488672.5, filed Jun. 23, 2017. The entire contents of the aforementioned patent applications are incorporated herein by this reference.

TECHNICAL FIELD

The present disclosure relates to a liquid crystal display technical field, and particularly, to a liquid crystal panel and a display driving method thereof.

BACKGROUND ART

With the development of photoelectric and semiconductor technology, a flat panel display has also been developed rapidly, and among various flat panel displays, a liquid crystal display (LCD) has been applied to various aspects of production and life for its many advantages, such as high space utilization efficiency, low power consumption, zero radiation and low electromagnetic interference.

A liquid crystal display generally includes a liquid crystal panel and a backlight module oppositely disposed, wherein since the liquid crystal panel cannot emit light, the backlight module is required to provide uniform display light for the liquid crystal panel so that the liquid crystal panel displays an image. The display modes of the current common liquid crystal panels mainly include a TN (Twisted Nematic) mode, a VA (Vertically Aligned) mode, an IPS (In-Plane Switching) mode and so on.

Wherein the VA display mode indicates a display mode in which liquid crystal molecules and a substrate are vertically aligned. The liquid crystal panel of the VA display mode has image display advantages with a high contrast and a high penetration rate, but an visual angle is poor. In order to improve the visual angle, in a liquid crystal panel of the VA display mode, long axes of liquid crystal molecules within pixels are vertical to a filter in a power-off state, each of pixels are divided into a plurality of domains (multi domain), liquid crystal molecules within each domain deflect toward respective directions in a power-on state, by this means, orientations of the liquid crystal molecules in the same pixel are divided into a plurality of directions to accordingly compensate visual angles of respective angles, thereby implementing uniform display in respective visual angle directions to effectively improve visual angle characteristics in a gray scale display state of different observing angles.

Eight domain partition is a commonly used partition of pixel domains, but since the larger number of thin film transistors and responded capacitances are adopted in a pixel of eight domains, an aperture ratio of the pixel may be seriously affected, and in order to compensate color cast of large visual angles, light intensities of some certain domains are reduced during the driving of the eight domain pixel structure, which both lead to reduction in the penetration rate of the liquid crystal panel.

SUMMARY

In order to solve the above problem in the prior art, the present disclosure aims to provide a liquid crystal panel and a display driving method thereof which implements compensation for a color cast in display of large visual angles on the premise of including a four domain pixel structure.

According to one embodiment of the present disclosure, a liquid crystal panel is provided, which includes N scan lines, M data lines and N×M pixels arranged in an array, and N and M are both positive integers; the scan lines extend in a row direction, the data lines extend in a column direction, the scan lines and the data lines cross each other and insulate from each other, the pixel is disposed at a cross of a corresponding one of the scan lines and a corresponding one of the data lines, and the pixel is connected to the corresponding one of the scan lines and the corresponding one of the data lines, respectively; when the liquid crystal panel is driven to display, n scan lines that are adjacent to each other receive high potential signals simultaneously, and the M data lines receive data signals simultaneously in a duration of the high potential signals; the n scan lines receive low potential signals simultaneously in a duration of first low potential signals after the duration of the high potential signals, and receive low potential signals having the lowest voltage simultaneously in a duration of second low potential signals after the duration of the first low potential signals, and the M data lines receive common voltage signals simultaneously in the duration of the first low potential signals and the duration of the second low potential signals; wherein $2 \leq n \leq N$, and n is a positive integer.

According to one embodiment of the present disclosure, alternatively, at least one of the n scan lines receives the low potential signals having the lowest voltage in the duration of the first low potential signals, and voltages of the low potential signals received by the rest of the n scan lines are all greater than the lowest voltage.

According to one embodiment of the present disclosure, alternatively, the scan lines which receive low potential signals having the lowest voltages are not adjacent to each other.

According to one embodiment of the present disclosure, alternatively, voltages of the low potential signals received by the rest of the n scan lines are different from one another.

According to one embodiment of the present disclosure, alternatively, N is an integral multiple of n.

According to another embodiment of the present disclosure, a display driving method of a liquid crystal panel is further provided, and the liquid crystal panel includes: N scan lines, M data lines and N×M pixels arranged in an array, and N and M are both positive integers, wherein the display driving method includes: supplying high potential signals for n scan lines that are adjacent to each other simultaneously, and supplying data signals for the M data lines simultaneously in a duration of the high potential signals; wherein $2 \leq n \leq N$, and n is a positive integer; supplying low potential signals for the n scan lines simultaneously in a duration of first low potential signals after the duration of the high potential signals, and supplying common voltage signals for the M data lines simultaneously in the duration of the first low potential signals; and supplying low potential signals having the lowest voltage for the n scan lines simultaneously in a duration of second low potential signals after the duration of the first low potential signals, and supplying common voltage signals for the M data lines simultaneously in the duration of the second low potential signals.

According to another embodiment of the present disclosure, alternatively, at least one of the n scan lines receives the low potential signal having the lowest voltage in the duration of the first low potential signals, and voltages of the low potential signals received by the rest of the n scan lines are all greater than the lowest voltage.

According to another embodiment of the present disclosure, alternatively, the scan lines which receive low potential signals having the lowest voltages are not adjacent to each other.

According to another embodiment of the present disclosure, alternatively, voltages of the low potential signals received by the rest of the n scan lines are different from one another.

According to another embodiment of the present disclosure, alternatively, N is an integral multiple of n.

The liquid crystal panel having a VA display mode of the present disclosure implements compensation for a color cast in display of large visual angles by regulating pixel voltages of pixels to affect deflection angles of liquid crystal molecules within pixels, on the premise of including a four domain pixel structure.

BRIEF DESCRIPTION OF THE DRAWINGS

These and other aspects, features and advantages of the present disclosure will become apparent from the following description of the embodiments, taken in conjunction with the accompanying drawings in which.

DETAILED DESCRIPTION OF THE EXEMPLARY EMBODIMENTS

Figure 1:
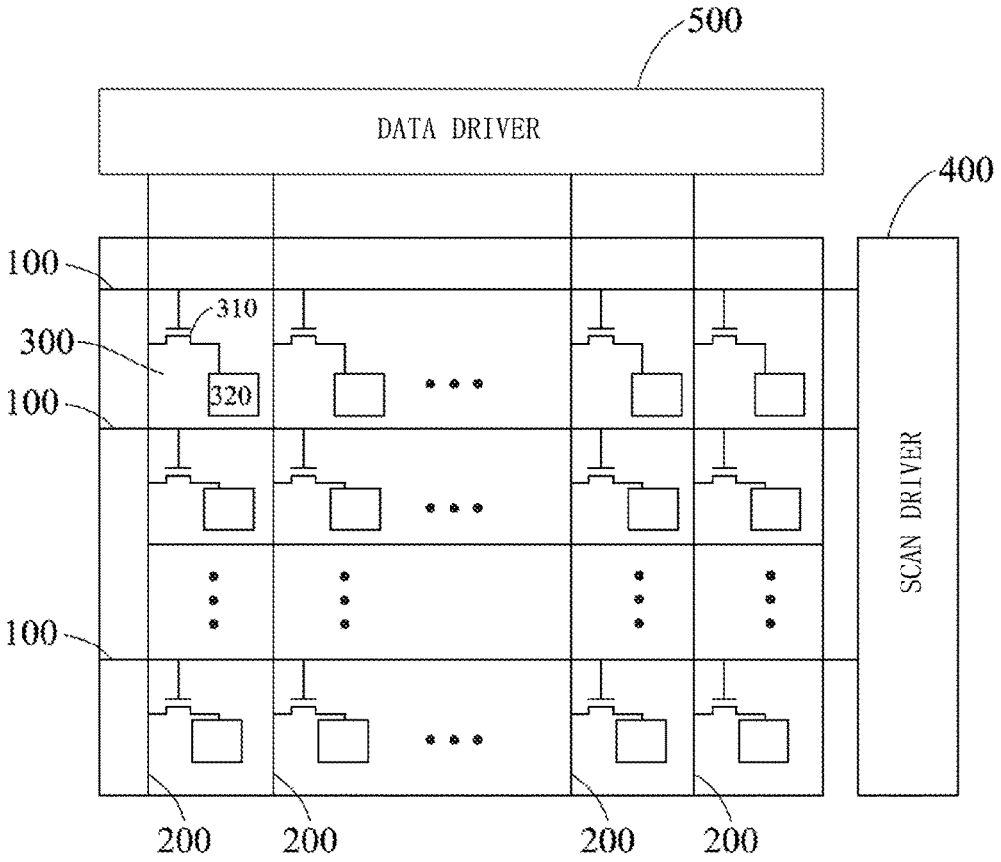
FIG. 1 is a structural diagram of a liquid crystal panel according to embodiments of the present disclosure.

Embodiments of the present disclosure will be described in detail below by referring to the accompany drawings. However, the present disclosure can be implemented in numerous different forms, and the present disclosure should not be explained to be limited hereto. Instead, these embodiments are provided for explaining the principle and actual application of the present disclosure, thus other skilled in the art can understand various embodiments and amendments which are suitable for specific intended applications of the present disclosure.

In the drawings, in order for clarify, thicknesses of layers and regions are exaggerated. The same reference numeral in the drawings and the description always indicates the same element.

FIG. 1 is a structural diagram of a liquid crystal panel according to embodiments of the present disclosure.

Referring to FIG. 1, a liquid crystal panel according to embodiments of the present disclosure includes: N scan lines 100, M data lines 200, N×M pixels 300 arranged in array, a scan driver 400 and a data driver 500. It should be understood that the liquid crystal panel according to embodiments of the present disclosure may further include necessary components, such as a sequential controller, and so on. In addition, it needs to be explained that the liquid crystal panel according to embodiments of the present disclosure has a VA display mode, and the pixel structure is designed to be a four domain pixel structure.

Specifically, each scan line 100 extends along a row direction, and the N scan lines 100 are arranged along a column direction, wherein respective scan lines 100 are mutually parallel to each other. Each data line 200 extends along a column direction, and the M data lines 200 are arranged along a row direction, wherein respective data lines 200 are mutually parallel to each other. As such, from a spatial point of view, scan lines 100 and data lines 200 cross each other and electrically insulate from each other to form N×M interleavings.

Each pixel 300 is disposed at a corresponding interleaving, and each pixel 300 is connected to the corresponding scan line 100 and the corresponding data line 200. As one embodiment of the present disclosure, the pixel 300 includes a thin film transistor 310 and a liquid crystal cell 320, a gate electrode of the thin film transistor 310 is connected to the corresponding one of the scan lines 100, a source electrode of the thin film transistor 310 is connected to the corresponding one of the data lines 200, a drain electrode of the thin film transistor 310 is connected to one end of the liquid crystal cell 320 and the other end of the liquid crystal cell 320 is connected to a common voltage line to receive a common voltage signal. Wherein the liquid crystal cell 320 is generally constructed by a liquid crystal capacitor (not shown) and a storage capacitor (not shown) in parallel, but the present disclosure is not limited thereto.

When the liquid crystal panel according to the embodiments of the present disclosure is driven to display, n scan lines 100 that are adjacent to each other receive high potential signals (or gate on signals) supplied by the scan driver 400 simultaneously to turn on the thin film transistor 310, and the M data lines 200 receive data signals supplied by the data driver 500 simultaneously in a duration of the high potential signals, the data signals being supplied to the liquid crystal cell 320 through the conducted thin film transistor 310; wherein a differential value between the data signal and the common voltage signal is a pixel voltage signal of the liquid crystal cell 320.

The n scan lines 100 receive low potential signals supplied by the scan driver 400 simultaneously in a duration of first low potential signals after the duration of the high potential signals, the n scan lines 100 receive low potential signals having the lowest voltage supplied by the scan driver 400 simultaneously in a duration of second low potential signals after the duration of the first low potential signals, and the M data lines 200 receive common voltage signals supplied by the data driver 500 simultaneously in the duration of the first low potential signals and the duration of the second low potential signals. Here, $2 \leq n \leq N$, and n is a positive integer.

Below, an example that n is 4 is taken to more particularly describe the display driving process of the liquid crystal panel according to the embodiments of the present disclosure.

Figure 2:
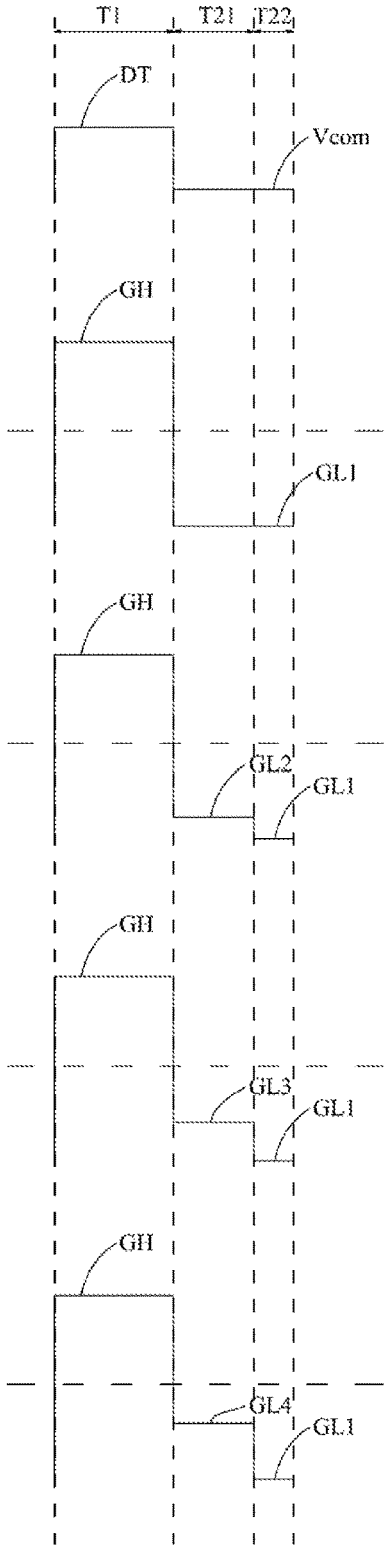
FIG. 2 is a sequential diagram of respective signals when a liquid crystal panel is driven to display according to embodiments of the present disclosure.

FIG. 2 is a sequential diagram of respective signals when a liquid crystal panel is driven to display according to embodiments of the present disclosure. In FIG. 2, a sequential diagram for a data signal and four scan signals received by four of the scan lines 100 that are adjacent to each other is shown. It needs to be explained that each scan signal is alternatively formed by a high potential signal and a low potential signal.

By referring to FIGS. 1 and 2 together, first, these four of the scan lines 100 receive high potential signals (or gate on signals) GH supplied by the scan driver 400 simultaneously in a duration T1 of the high potential signals (or gate on signals) to turn on the thin film transistor 310, and the M data lines 200 receive data signals DT supplied by the data driver 500 simultaneously in the duration T1 of the high potential signals, the data signals DT being supplied to the liquid crystal cell 320 through the conducted thin film transistor 310; wherein a differential value between the data signal DT and a common voltage signal Vcom is a pixel voltage signal of the liquid crystal cell 320.

Next, these four of the scan lines 100 receive low potential signals GL1, GL2, GL3 and GL4 supplied by the scan driver 400 simultaneously in a duration T21 of the first low potential signals after the duration T1 of the high potential signals, and the M data lines 200 receive the common voltage signal Vcom supplied by the data driver 500 simultaneously in the duration T21 of the first low potential signals.

At least one of the low potential signals GL1, GL2, GL3 and GL4 is a low potential signal (or a gate off signal) having the lowest voltage, here the low potential signal having the lowest voltage can turn off the thin film transistors 310 totally. Here, the low potential signal GL1 is disposed to be a low potential signal having the lowest voltage, while the voltages of the low potential signals GL2, GL3 and GL4 are all greater than the lowest voltage.

As such, the thin film transistors 310 which receive the low potential signals having the lowest voltage are turned off totally in the duration T21 of the first low potential signals. The thin film transistors 310 which receive the low potential signals GL2, GL3 and GL4 is not turned off totally in the duration T21 of the first low potential signals, so that electric leakage phenomenon will occur to these thin film transistors 310, which causes pixel voltages in the liquid crystal cells 320 connected to these thin film transistors 310 to be lower than the pixel voltages in the liquid crystal cells 320 connected to these thin film transistors 310 which are turned off totally, thereby further affecting deflection angles of liquid crystal molecules in respective liquid crystal cells 320 and thus implementing compensation for a color cast of large visual angles.

Further, in the present embodiment, voltages of low potential signals GL2, GL3 and GL4 are different, as such, in pixels connected to these four scan lines 100, intensities of light among pixels of respective rows have differences, such that deviations in intensities of light of the pixels in adjacent rows are improved as a whole, thereby further improving compensation for a color cast in display of large visual angles of the liquid crystal panel according to the embodiments of the present disclosure.

Furthermore, the number N of scan lines 100 of the liquid crystal panel of the embodiments of the present disclosure is disposed to be an integer multiple of 4, that is, N is disposed to be an integer multiple of n, thereby implementing partition processing of a liquid crystal panel.

In addition, as another embodiment of the present disclosure, low potential signals GL1 and GL3 may be disposed to be low potential signals having the lowest voltage, while the voltages of low potential signals GL2 and GL3 are greater than the lowest voltage, as such, the scan lines which receive low potential signals GL2 and GL4 are respectively disposed below the scan lines 100 which receive low potential signals GL1 and GL3, so that the scan lines 100 which receive low potential signals GL1 and GL3 are not adjacent, so as to improve deviations in intensities of light of the pixels in adjacent rows, and to better implement compensation for a color cast in display of large visual angles of the liquid crystal panel according to the embodiments of the present disclosure.

Finally, these four of the scan lines 100 receive low potential signals having the lowest voltage supplied by the scan driver 400, namely, a low potential signal GL1, simultaneously in a duration T22 of second low potential signals after the duration T21 of the first low potential signals, and the M data lines 200 receive the common voltage signal Vcom supplied by the data driver 500 simultaneously in the duration T22 of the second low potential signals.

In this way, the display driving of a frame of the liquid crystal panel according to the embodiments of the present disclosure is accomplished. Below a display driving method of the liquid crystal panel according to the embodiments of the present disclosure is explained.

Figure 3:
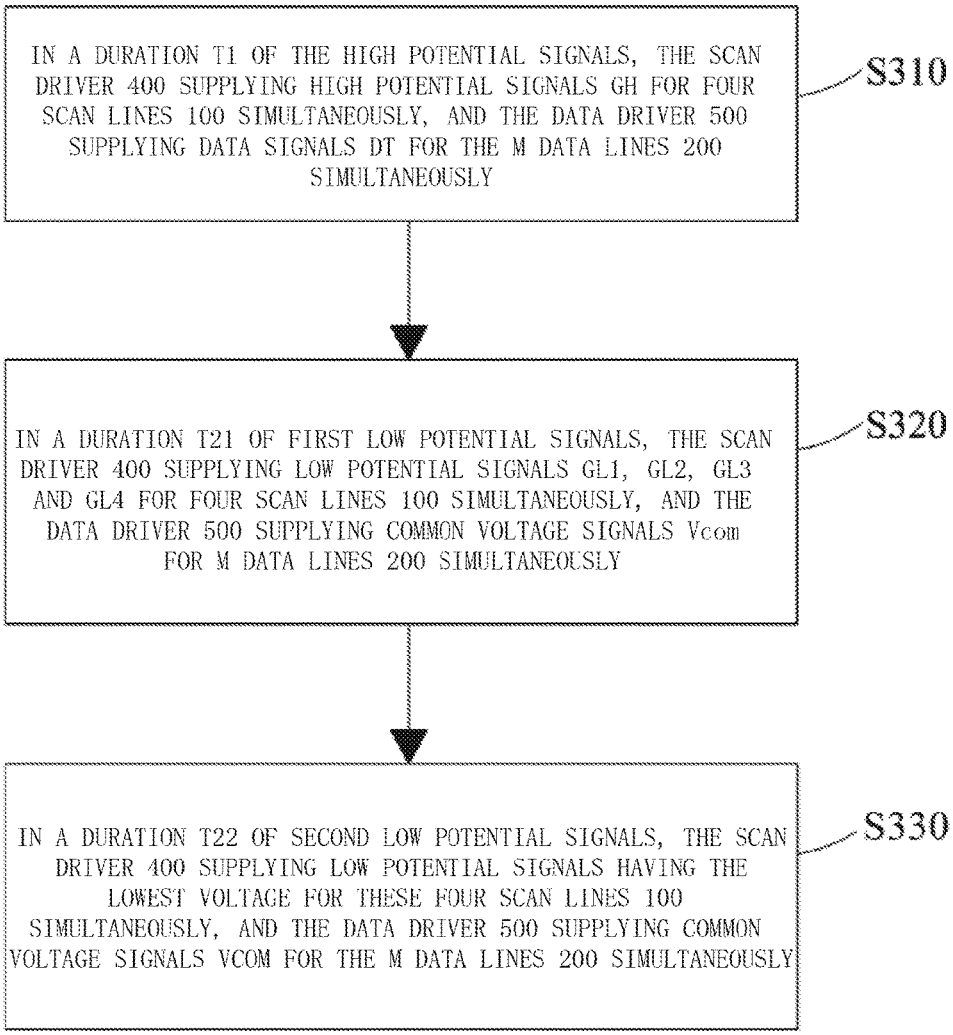
FIG. 3 is a flow diagram of a display driving method of a liquid crystal panel according to embodiments of the present disclosure.

FIG. 3 is a flow diagram of a display driving method of a liquid crystal panel according to embodiments of the present disclosure.

Referring to FIG. 1 to FIG. 3 together, a display driving method of the liquid crystal panel according to embodiments of the present disclosure includes:

Step S310: the scan driver 400 supplies high potential signals GH for four scan lines 100 simultaneously in a duration T1 of the high potential signals to turn on the thin film transistor 310, and the data driver 500 supplies data signals DT for M data lines 200 simultaneously in the duration T1 of the high potential signals, the data signals DT being supplied to the liquid crystal cell 320 through the conducted thin film transistor 310.

Step S320: the scan driver 400 supplies low potential signals GL1, GL2, GL3 and GL4 for four scan lines 100 simultaneously in a duration T21 of first low potential signals after the duration T1 of the high potential signals, and the data driver 500 supplies common voltage signals Vcom for the M data lines 200 simultaneously in the duration T21 of the first low potential signals.

Step S330: the scan driver 400 supplies low potential signals having the lowest voltage for these four scan lines 100, namely, a low potential signal GL1, simultaneously in a duration T22 of second low potential signals after the duration T21 of the first low potential signals, and the data driver 500 supplies common voltage signals Vcom for the M data lines 200 simultaneously in the duration T22 of the second low potential signals.

To sum up, the liquid crystal panel having a VA display mode according to the embodiments of the present disclosure implements compensation for a color cast in display of large visual angles by regulating pixel voltages of pixels to affect deflection angles of liquid crystal molecules within pixels, on the premise of including a four domain pixel structure.

Although the present disclosure has been described with reference to the special exemplary embodiments, those skilled in the art will understand: various changes in form and details may be made therein without departing from the spirit and scope of the disclosure as defined by the appended claims and its equivalents.

The invention claimed is:

1. A liquid crystal panel comprising N scan lines, M data lines and N×M pixels arranged in an array, N and M being both positive integers;

the scan lines extending in a row direction, the data lines extending in a column direction, the scan lines and the data lines crossing each other and insulating from each other, the pixels each being disposed at a cross of corresponding one of the scan lines and corresponding one of the data lines and being connected to the corresponding one of the scan lines and the corresponding one the data lines, respectively, wherein when the liquid crystal panel is driven to display, n scan lines that are adjacent to each other receive high potential signals simultaneously, and the M data lines receive data signals simultaneously in a duration of the high potential signals; and the n scan lines receive low potential signals simultaneously in a duration of first low potential signals after the duration of the high potential signals, and receive low potential signals having a lowest voltage simultaneously in a duration of second low potential signals after the duration of the first low potential signals, and the M data lines receive common voltage signals simultaneously in the duration of the first low potential signals and the duration of the second low potential signals, wherein a potential signal of each of the n scan lines is maintained substantially constant during the duration of the high potential signals, the duration of the first low potential signals, and the duration of the second low potential signals, and wherein $2 \leq n \leq N$, and n is a positive integer.

2. The liquid crystal panel of claim 1, wherein at least one of the n scan lines receives the low potential signals having the lowest voltage in the duration of the first low potential signals, and voltages of the low potential signals received by the rest of the n scan lines are all greater than the lowest voltage.

3. The liquid crystal panel of claim 2, wherein the scan lines which receive low potential signals having the lowest voltage are not adjacent to each other.

4. The liquid crystal panel of claim 3, wherein voltages of the low potential signals received by the rest of the n scan lines are different from one another.

5. The liquid crystal panel of claim 2, wherein voltages of the low potential signals received by the rest of the n scan lines are different from one another.

6. The liquid crystal panel of claim 1, wherein N is an integer multiple of n.

7. A display driving method of a liquid crystal panel comprising N scan lines, M data lines and N×M pixels arranged in an array, and N and M being both positive integers, the display driving method comprising:

supplying high potential signals for n scan lines that are adjacent to each other simultaneously, and supplying data signals for M data lines simultaneously in a duration of the high potential signals; wherein $2 \leq n \leq N$, and n is a positive integer;

supplying low potential signals for the n scan lines simultaneously in a duration of first low potential signals after the duration of the high potential signals, and supplying common voltage signals for the M data lines simultaneously in the duration of the first low potential signals; and supplying low potential signals having the lowest voltage for the n scan lines simultaneously in a duration of second low potential signals after the duration of the first low potential signals, and supplying common voltage signals for M data lines simultaneously in the duration of the second low potential signals, wherein a potential signal of each of the n scan lines is maintained substantially constant during the duration of the high potential signals, the duration of the first low potential signals, and the duration of the second low potential signals.

8. The display driving method of the liquid crystal panel of claim 7, wherein at least one of the n scan lines receives a low potential signal having the lowest voltage in the duration of the first low potential signals, and voltages of the low potential signals received by the rest of the n scan lines are all greater than the lowest voltage.

9. The display driving method of the liquid crystal panel of claim 8, wherein voltages of the low potential signals received by the rest of the n scan lines are different from one another.

10. The display driving method of the liquid crystal panel of claim 7, wherein the scan lines which receive low potential signals having the lowest voltages are not adjacent to each other.

11. The display driving method of the liquid crystal panel of claim 10, wherein voltages of the low potential signals received by the rest of the n scan lines are different from one another.

12. The display driving method of liquid crystal panel of claim 7, wherein N is an integer multiple of n.

* * * * *